US006843080B1

(12) United States Patent
Yu

(10) Patent No.: US 6,843,080 B1
(45) Date of Patent: Jan. 18, 2005

(54) LOCK WITH BENDABLE SHACKLE ELEMENT OPENABLE IN TWO WAYS

(76) Inventor: Chun-Te Yu, No. 41-21, Kuan-Tsui St., Hsia-Nien Tsun, Fu-Hsing Hsiang, Changhua County (TW)

( * ) Notice: Subject to any disclaimer, the term of this patent is extended or adjusted under 35 U.S.C. 154(b) by 0 days.

(21) Appl. No.: 10/828,268

(22) Filed: Apr. 21, 2004

(30) Foreign Application Priority Data

Feb. 27, 2004 (TW) ..... 93202972 U

(51) Int. Cl.[7] ..... E05B 37/02

(52) U.S. Cl. ..... 70/21; 70/25; 70/30; 70/49; 70/53; 70/284; 70/285; 70/DIG. 63

(58) Field of Search ..... 70/21, 25, 29, 70/30, 43, 46, 49, 53, 284, 285, DIG. 63, DIG. 71

(56) References Cited

U.S. PATENT DOCUMENTS 1,755,521 A * 4/1930 Smith ..... 70/21
3,750,431 A * 8/1973 Atkinson ..... 70/21
4,325,240 A * 4/1982 Gable ..... 70/284
4,918,951 A * 4/1990 Kavizky ..... 70/53
5,367,785 A * 11/1994 Benarroch ..... 33/767
5,694,797 A * 12/1997 Kuo ..... 70/53
5,868,012 A * 2/1999 Chun-Te et al. ..... 70/30
6,227,016 B1 * 5/2001 Yu ..... 70/30
6,389,854 B1 * 5/2002 Huang ..... 70/58
6,408,660 B1 * 6/2002 Lai ..... 70/30
6,539,761 B2 * 4/2003 Yang ..... 70/284
6,708,534 B1 * 3/2004 Ruan ..... 70/38 A

* cited by examiner

*Primary Examiner*—Lloyd A. Gall
(74) *Attorney, Agent, or Firm*—Troxell Law Office PLLC

(57) ABSTRACT

A lock with bendable shackle element openable in two ways mainly includes a main body, a bendable shackle element, a combination lock core, and a key lock core. The bendable shackle element has an end fixedly connected to the main body, and the other end movably held to a lock slot on the main body. Two ends of the lock slot are first and second locking holes respectively corresponding to the key lock core and the combination lock core, which control a blocking head and a shifting member, respectively, to block or open the two locking holes. The movable end of the bendable shackle element may be moved to one of the two locking holes to open the lock when the combination or the key lock core is released to move the shifting member or the blocking head away from a corresponding locking hole.

23 Claims, 7 Drawing Sheets

LOCK WITH BENDABLE SHACKLE ELEMENT OPENABLE IN TWO WAYS

FIELD OF THE INVENTION

The present invention relates to a lock with bendable shackle element openable in two ways, and more particularly to a lock with bendable shackle element that has a combination lock core and a key lock core, and could be opened via any one of the two lock cores.

BACKGROUND OF THE INVENTION

Locks with a flexible or bendable shackle element made of, for example, a steel cord lock, are widely employed in some specific applications, such as locks for motorcycles and bicycles.

Conventional locks may be generally divided into two categories according to the way of opening them, namely, key-controlled locks and key-free locks. Generally speaking, the key-controlled lock is a lock that must be opened with an auxiliary tool, that is, a key. The key-controlled lock has the advantages of simple structure and easy operation. However, a user has to carefully keep the key for opening the lock. It will bring a user a lot of inconveniences or troubles, in the event the key is lost. Combination locks are the most common key-free locks, and usually include complicate structure and a large number of components. While the combination locks do not have the problem of a missing key, they are less convenient to operate.

Therefore, it is desirable to develop a lock openable in two ways that combines the advantages of the conventional key lock and the combination lock, and could be opened with or without a key.

SUMMARY OF THE INVENTION

A primary object of the present invention is to provide a lock with bendable shackle element openable in two ways.

To achieve the above and other objects, the lock according to the present invention mainly includes a main body, a substantially U-shaped bendable shackle element, a combination lock core, and a key lock core. The combination lock core and the key lock core are independent of each other. The bendable shackle element has an end fixedly connected to the main body, and the other end movably held to a lock slot formed on the main body. Two ends of the lock slot are first and second locking holes respectively corresponding to the key lock core and the combination lock core. In an embodiment of the present invention, the key lock core and the combination lock core control a blocking head and a shifting member, respectively, to block or open the two locking holes. The movable end of the bendable shackle element may be moved to one of the two locking holes to separate from the lock slot and thereby open the lock when the combination or the key lock core is released from a locked state and drive the shifting member or the blocking head away from a corresponding locking hole.

In the lock of the present invention, the bendable shackle element may be made of a flexible material, such as a steel cord, or formed from two pivotally connected rigid curved bars or tubes to achieve the same good effect. The bendable shackle element may be structurally changed in different ways to meet actual needs in manufacture and practical use of the lock.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
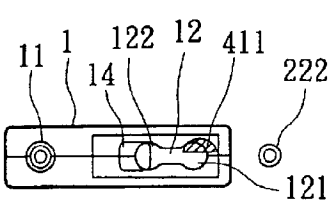
FIG. 1A is a cross sectional view taken along line A—A of FIG. 1.
Figure 1:
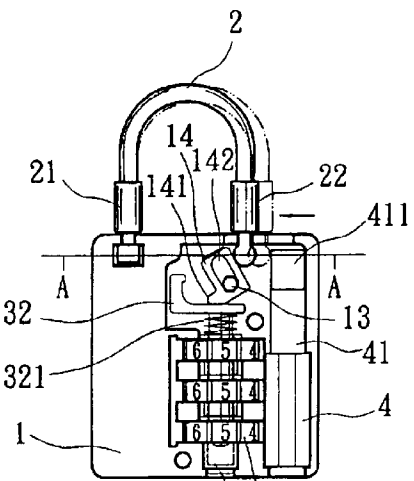
FIG. 1 is a schematical plan view showing the structure of a lock according to a first embodiment of the present invention, wherein the lock is in a locked state.

Please refer to FIG. 1 that is a schematical plan view of a lock according to a first embodiment of the present invention, and to FIG. 1A that is a cross sectional view taken along line A—A of FIG. 1. As shown, the lock according to the present invention mainly includes a main body 1, a bendable shackle element 2, a combination lock core 3, and a key lock core 4. The main body 1 is provided at one peripheral wall thereof with a recess 11, and a locking slot 12 opposite to the recess 11. Two ends of the locking slot 12 are formed into a first locking hole 121 and a second locking hole 122 located between the first locking hole 121 and the recess 11. A horizontal shaft 13 is provided inside the main body 1 close to the second locking hole 122 to transversely extend through a long hole 142 on a shifting member 14. The shifting member 14 is provided at a lower side with a laterally projected nose portion 141.

The bendable shackle element 2 is a U-shaped flexible bar or tube, two ends of which are separately formed into a fixed head 21 and a movable head 22. The fixed head 21 is inserted into the recess 11 to be pivotally turnable relative to the recess 11. A free end of the movable head 22 is formed into a stopper 222, so that an annular groove 221 is formed between the stopper 222 and the other portion of the movable head 22, allowing the movable head 22 to extend into the locking slot via the first or the second locking hole 121, 122 and move to a narrowed middle portion of the locking slot 12 to be retained thereto.

The combination lock core 3 has an inner end connected to a stop plate 32. A spring 321 is put around the inner end of the combination lock core 3 to elastically press against the stop plate 32, so that the stop plate 32 is normally pushed upward to abut against the lower side of the shifting member 14. A plurality of number rings 31 are put around a middle portion of the combination lock core 3, such that a circumferential outer surface of each of the number rings 31 is partially exposed from the main body 1. Through turning the number rings 31, the stop plate 32 is controlled by the combination lock core 3 to locate at a locked position.

The key lock core 4 is provided inside the main body 1, and has an inner end formed into a turnable portion 41 that could be turned using a correct key. An inner end of the turnable portion 41 of the key lock core 4 is a blocking head 411, which may be a semi-circular-sectioned rod moving along with the turnable portion 41, or a stop block that can be pushed to move by the turnable portion 41. When the key lock core 4 is in a locked state, either type of the blocking head 411 is turned or pushed to move into a space below the first locking hole 121 of the main body 1, so as to stop the movable head 22 of the bendable shackle element 2 from moving out of the locking slot 12 on the main body 1 via the first locking hole 121 to open the lock.

In other words, when the lock of the present invention is in a locked state, the stop plate 32 of the combination lock core 3 is upward pressed against the shifting member 14 to cause the shifting member 14 to block out the second locking hole 122, and the blocking head 411 is moved by the turnable portion 41' of the key lock core 4 into the space below the first locking hole 121. With the shifting member 14 and the blocking head 411 located at positions blocking out the second and the first locking hole 122, 121, respectively, the stopper 222 of the bendable shackle element 2 is effectively stopped from moving out of the locking slot 12 via the first or the second locking hole 121 or 122. That is, the lock of the present invention is in a securely locked state.

Figure 2A:
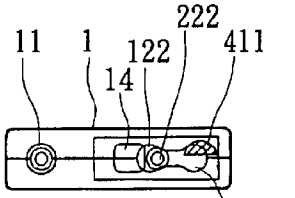
FIG. 2A is a cross sectional view taken along line A—A of FIG. 2.
Figure 3A:
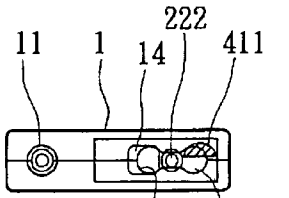
FIG. 3A is a cross sectional view taken along line A—A of FIG. 3.
Figure 2:
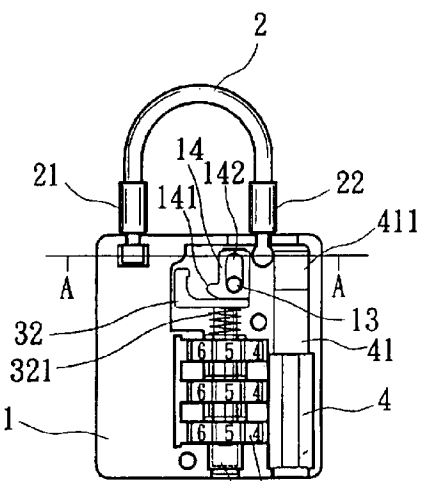
FIG. 2 shows the manner of unlocking the lock of FIG. 1 via a combination lock core thereof.
Figure 3:
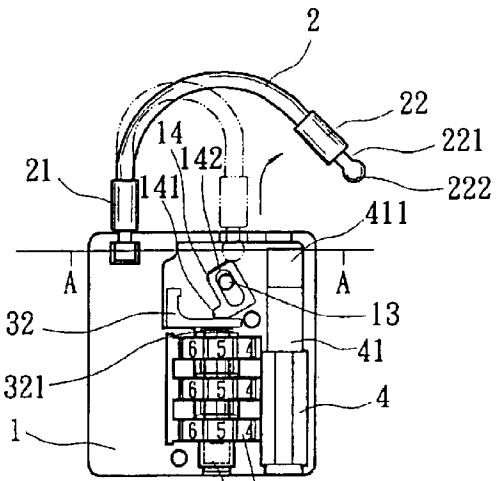
FIG. 3 is a further view showing the manner of unlocking the lock of FIG. 1 via the combination lock core thereof.

FIGS. 2, 2A, 3, and 3A show the manner of unlocking the lock of the first embodiment of the present invention via the combination lock core 3 thereof. As shown in FIG. 2, when the number rings 31 mounted on the combination lock core 3 are turned to correct unlocking positions, the stop plate 32 is no longer firmly pressed against by the combination lock core 3. At this point, the movable head 22 of the bendable shackle element 2 may be shifted from the middle portion of the locking slot 12 toward the second locking hole 122, so that the stopper 222 is brought to push the shifting member 14, as shown in FIGS. 2 and 2A, causing the shifting member 14 to deflect with the laterally projected nose portion 141 bearing and pushing against the stop plate 32. The shaft 13 restricts the shifting member 14 to deflect within a limited scope. The long hole 142 of the shifting member 14 absorbs any displacement of the shifting member 14 relative to the shaft 13 while being deflected. When the deflected shifting member 14 has been completely moved away from the second locking hole 122, the stopper 222 of the bendable shackle element 2 may be shifted into the second locking hole 122 and pulled outward to open the lock, as shown in FIGS. 3 and 3A.

Figure 5A:
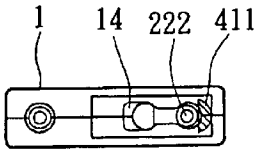
FIG. 5A is a cross sectional view taken along line A—A of FIG. 5.
Figure 5:
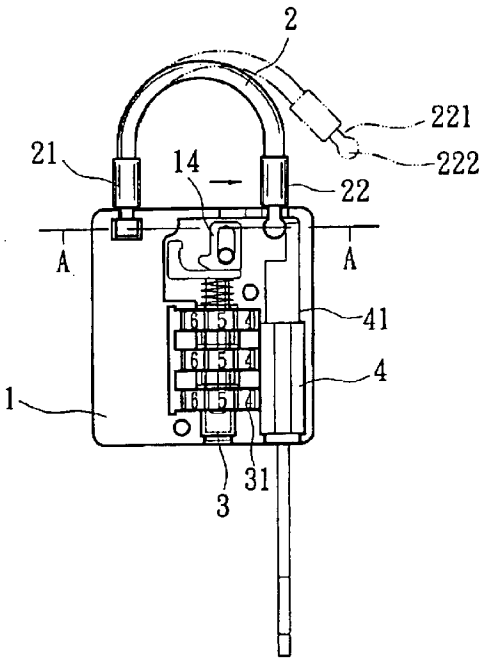
FIG. 5 is a further view showing the manner of unlocking the lock of FIG. 1 via the key lock core thereof.
Figure 4A:
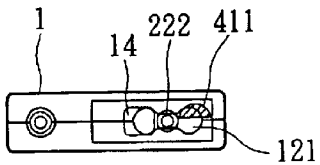
FIG. 4A is a cross sectional view taken along line A—A of FIG. 4.
Figure 4:
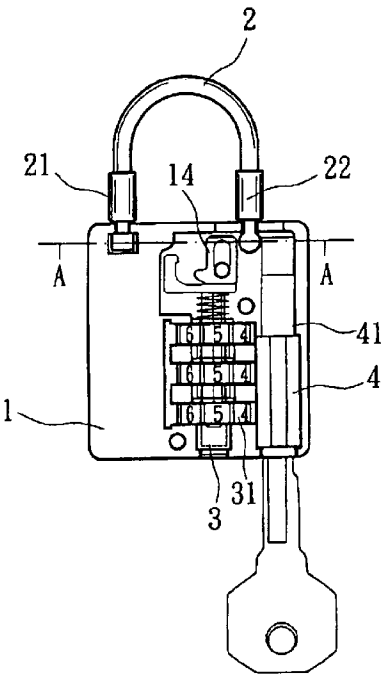
FIG. 4 shows the manner of unlocking the lock of FIG. 1 via a key lock core thereof.

FIGS. 4, 4A, 5, and 5A show the manner of unlocking the lock of the first embodiment of the present invention via the key lock core 4 thereof. In the case the blocking head 411 moved along with the turnable portion 41 of the key lock core 4 is a semi-circular-sectioned rod having a straight inner side and a curved outer side, and the lock of the present invention is in the locked state, the blocking head 411 is turned to project into the space below the first locking hole 121, as shown in FIGS. 4 and 4A, and the stopper 222 of the bendable shackle element 2 is stopped from shifting from the middle portion of the locking slot 12 toward the first locking hole 121 to open the lock. When a correct key is inserted into the key lock core 4, the turnable portion 41 is driven to rotate and bring the straight inner side of the semi-circular rod 411 to face toward the locking slot 12, so that the rod 411 no longer projects into the space below the first locking hole 121, as shown in FIG. 5A. At this point, the stopper 222 of the bendable shackle element 2 may be shifted from the middle portion of the locking slot 12 into the first locking hole 121 and pulled outward to open the lock, as shown in FIG. 5.

Figure 6:
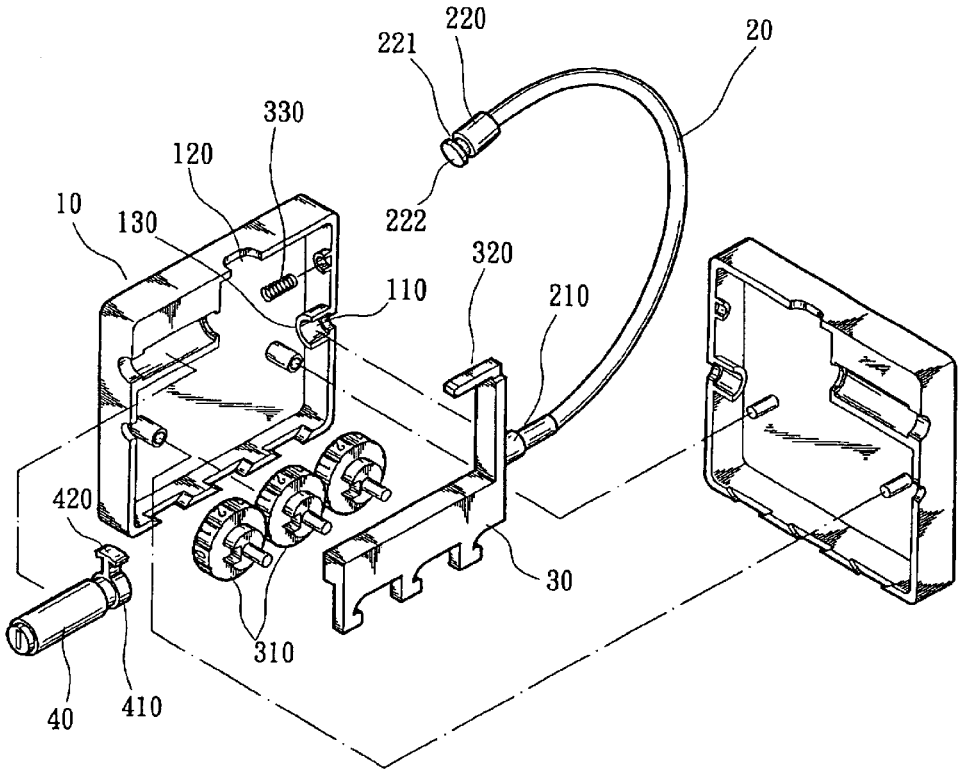
FIG. 6 is an exploded perspective view of a lock according to a second embodiment of the present invention.
Figure 7:
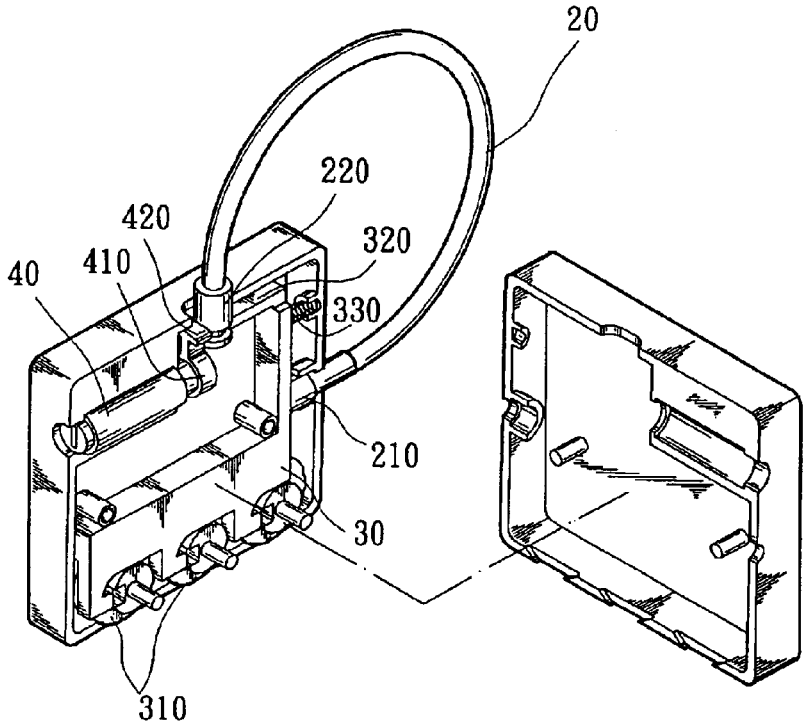
FIG. 7 is a partially assembled view of FIG. 6.
Figure 8:
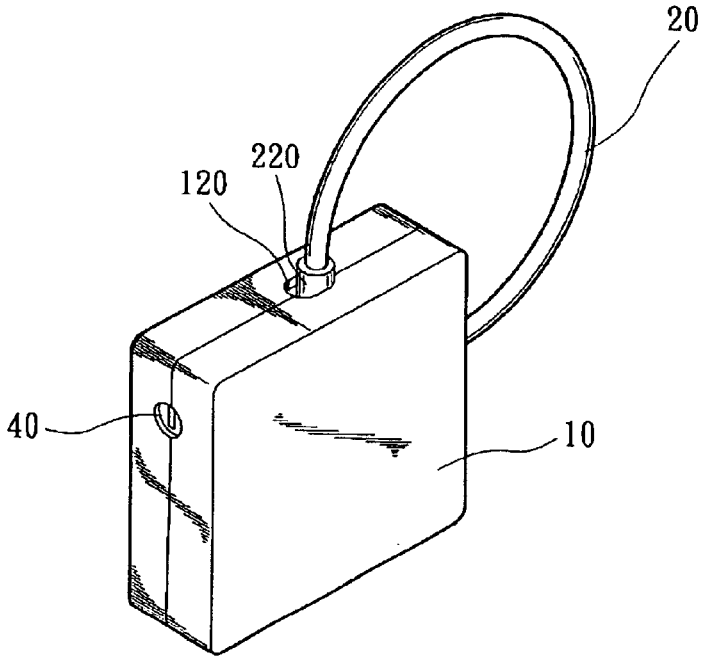
FIG. 8 is a fully assembled perspective view of FIG. 6.

FIG. 6 is an exploded perspective view of a lock according to a second embodiment of the present invention, FIGS. 7 and 8 are partially and fully assembled perspective views, respectively, of the lock of FIG. 6. As shown, the lock according to the second embodiment of the present invention mainly includes a main body 10, a bendable shackle element 20, a combination lock core 30, and a key lock core 40. The main body 10 is provided at one of four peripheral walls with a through hole 110, and at a second peripheral wall adjacent to the first peripheral wall with a long locking hole 120. A guide sleeve 130 is extended from the through hole 110 toward an interior of the main body 10.

The bendable shackle element 20 is an elongate flexible member with two ends separately formed into a fixed head 210 and a movable head 220. The fixed head 210 is extended through the through hole 110 and the guide sleeve 130 into the main body 10. The movable head 220 is extended into the main body 10 via the long locking hole 120, and has a free end formed into a stopper 222 and an annular groove 221 located between the stopper 222 and the remaining portion of the movable head 220.

The combination lock core 30 is a substantially L-shaped member. A plurality of number rings 310 are mounted on a middle portion of a first section of the L-shaped combination lock core 30 parallel to a third peripheral wall adjacent to the first peripheral wall for controlling a sideward movement of the combination lock core 30 in the main body 10. A circumferential outer surface of each of the number rings 310 is partially exposed from the third peripheral wall of the main body 10. A middle portion of a second section of the L-shape combination lock core 30 is connected to an inner end of the fixed head 210, which is extended into the main body 10 via the through hole 110, the guide sleeve 130 encloses the fixed head 210 to locate the latter in place, so that the combination lock core 30 connected with the fixed head 210 of the bendable shackle element 20 is shifted toward the guide sleeve 130. A spring 330 is provided in the main body 10 to locate above the fixed head 210 with an outer end pressed against an inner side of the first peripheral wall and an inner end pressed against the second section of the L-shaped combination lock core 30. The second section of the L-shaped combination lock core 30 has a top that is sideward turned to form a pin portion 320, a free end of which is closely located-below one end of the long locking hole 120 closer to the first peripheral wall of the main body 10.

The key lock core 40 is also provided inside the main body 10. An inner end of the key lock core 40 is a turnable portion 410 that may be turned using a correct key. A free end of the turnable portion 410 is formed into a stop head having a radially outward extended stop lug 420.

Figure 9:
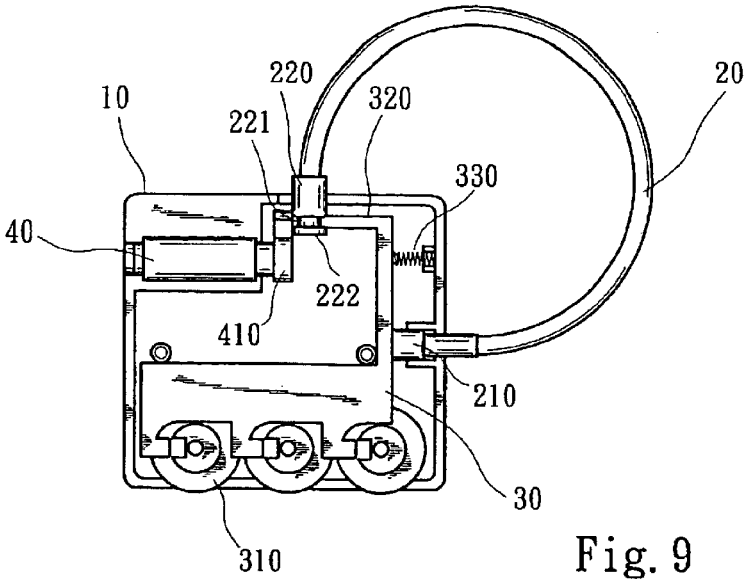
FIG. 9 is a plan view showing an internal structure of the lock according to the second embodiment of the present invention, wherein the lock is in a locked state.
Figure 10:
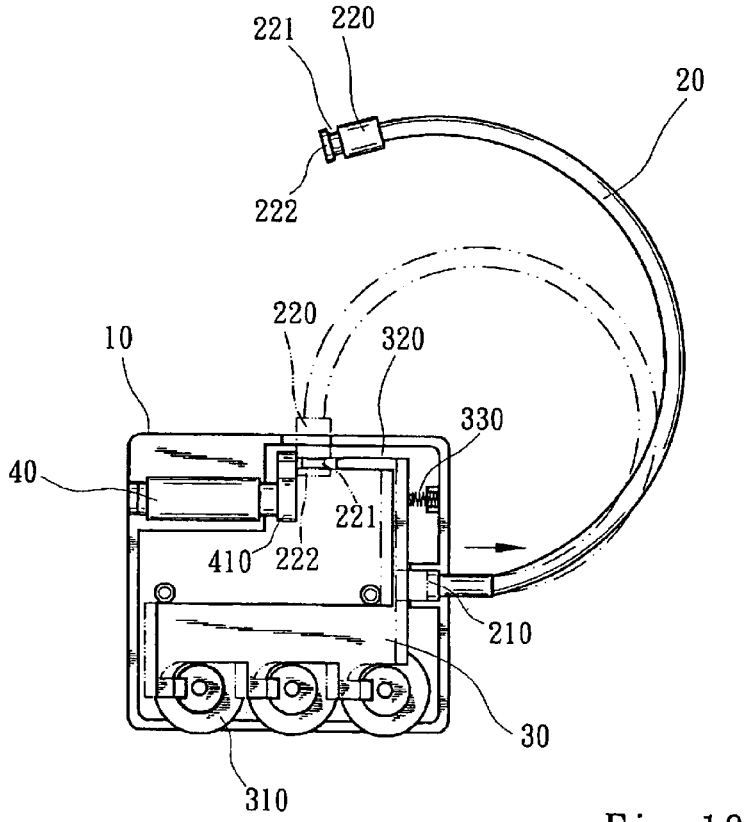
FIG. 10 shows the manner of unlocking the lock of FIG. 9 via a combination lock core thereof.

FIG. 9 is a plan view showing an internal structure of the lock according to the second embodiment of the present invention, wherein the lock is in a locked state. FIG. 10 shows the manner of unlocking the lock of FIG. 9 via the combination lock core 30. As shown in FIG. 9, when the lock is in a locked state, the spring 330 elastically pushes the combination lock core 30 for the pin portion 320 to engage with the annular groove 221 at the movable head 220 of the bendable shackle element 20. Meanwhile, the stop lug 420 at the free end of the turnable portion 410 of the key lock core 40 is locked at the other end of the long locking hole 120, such that the stopper 222 is firmly clamped between the pin portion 320 and the stop lug 420 without the risk of separating from the long locking hole 120. And, when the number rings 310 are turned to correct unlocking positions to release the combination lock core 30 from a locked state, the fixed head 210 of the bendable shackle element 20 may be pulled outward to synchronously shift the combination lock core 30 sideward and thereby disengages the pin portion 320 from the annular groove 221, allowing the stopper 222 of the movable head 220 of the bendable shackle element 20 to move out of the long locking hole 120 to open the lock, as shown in FIG. 10.

Figure 11:
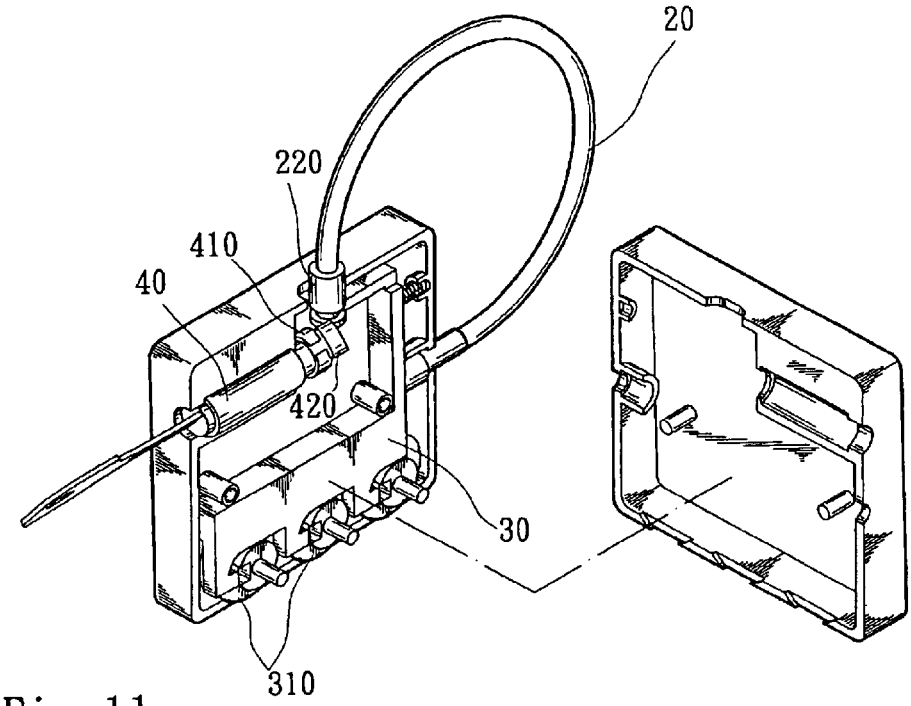
FIG. 11 is a perspective view showing the manner of unlocking the lock of FIG. 9 via a key lock core thereof.
Figure 12:
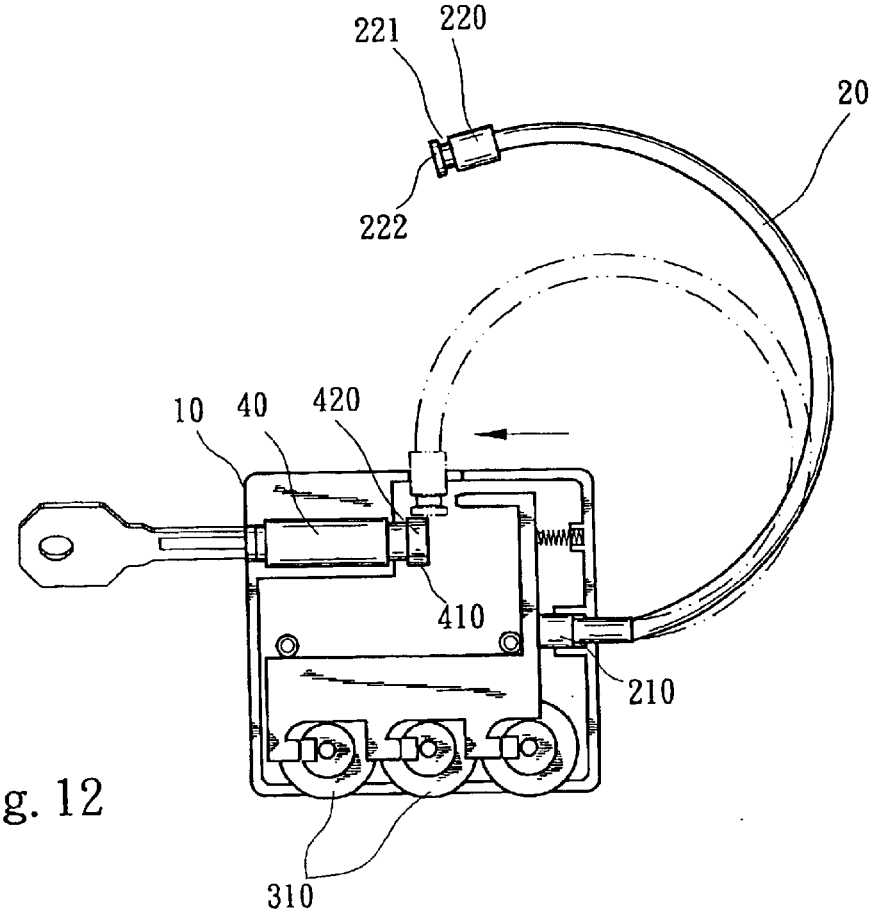
FIG. 12 is a plan view showing the manner of unlocking the lock of FIG. 9 via the key lock core thereof.

FIGS. 11 and 12 are perspective views showing the manner of unlocking the lock according to the second embodiment of the present invention via the key lock core 40. When a correct key is inserted into the key lock core 40, the turnable portion 410 is driven to rotate and brings the stop lug 420 to move away from the long locking hole 120, as shown in FIG. 11. At this point, the stopper 222 at the movable head 220 of the bendable shackle element 20 is free at the side opposite to the pin portion 320, and could therefore be pulled out of the long locking hole 120 to open the lock, as shown in FIG. 12.

Figure 13A:
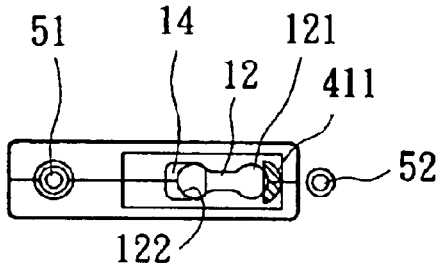
FIG. 13A is a cross sectional view taken along line A—A of FIG. 13.
Figure 13:
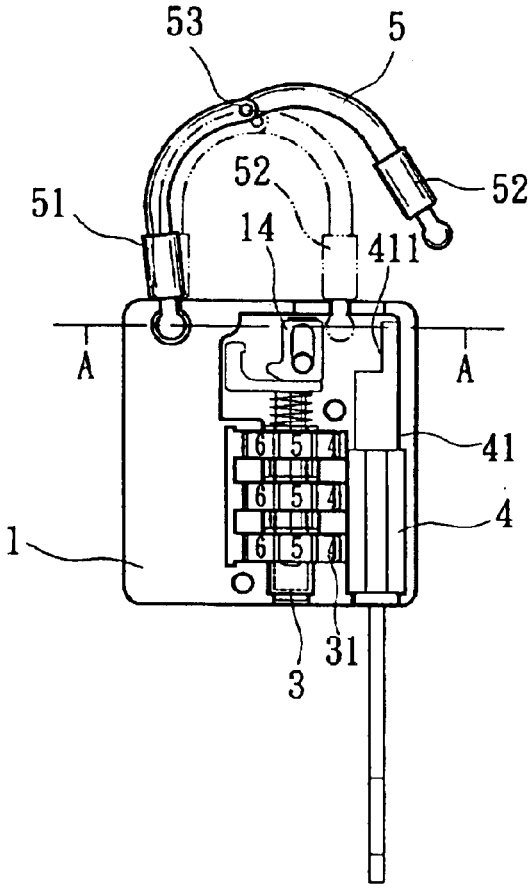
FIG. 13 is a schematical plan view showing a lock according to a third embodiment of the present invention.

Please refer to FIG. 13 that shows a lock according to a third embodiment of the present invention. Unlike the first and the second embodiment, in which the bendable shackle elements 2, 20 are made of a conventional flexible material, such as a steel cord, the third embodiment includes a bendable shackle element 5 that consists of at least two curved sections made of rigid or relatively hard bars or tubes and pivotally connected to one another by pivot pin or pins 53. Two outmost ends of the pivotally connected curved sections of the bendable shackle element 5 are formed into a fixed and a movable head 51 and 52, respectively. Since the movable head 52 has a structure similar to that of the movable head 22 or 220, it is not described in details herein. The fixed head 51 is preferable in the form of a ball joint. The bendable shackle element 5 formed from pivotally connected curved bars or tubes may be bent to complete the same movement of opening the lock, just as the bendable shackle elements 2 and 20.

From the above description, it is understood the lock with bendable shackle element according to the present invention may be opened either via the combination lock core or the key lock core thereof, and is therefore very practical and convenient for use.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A lock with bendable shackle element openable in two ways, comprising a main body, a bendable shackle element, a combination lock core, and a key lock core:

said main body being provided at one peripheral wall with a locking slot, two ends of which are separately formed into a first locking hole and a second locking hole; a shifting member being provided inside said main body close to said second locking hole to be deflected through control of said combination lock core, and a blocking head being provided in said main body close to said first locking hole to be moved through control of said key lock core;

said bendable shackle element having two ends separately formed into a fixed head and a movable head, said fixed head being pivotally turnably connected to said main body, and said movable head being provided at a free end with a stopper, which is adapted to move into or out of said locking slot via either said first or said second locking hole;

whereby when said shifting member and said blocking head are controlled by said combination lock core and said key lock core, respectively, to interfere with said second or said first locking hole, respectively, said movable head of said bendable shackle element is prevented from moving through said locking slot via said second or said first locking hole and thereby locks said lock; and when either said shifting member or said blocking head is controlled by said combination lock core or said key lock core, respectively, to move away from said second or said first locking hole, respectively, said movable head of said bendable shackle element is allowed to move through said locking slot via said second or said first locking hole to open said lock.

2. The lock with bendable shackle element openable in two ways as claimed in claim 1, wherein said combination lock core has an inner end bearing against a lower side of said shifting member, and a middle portion having a plurality of number rings mounted therearound for driving said combination lock core to a locked or a released state; and circumferential outer surfaces of said number rings being partially exposed from said main body.

3. The lock with bendable shackle element openable in two ways as claimed in claim 1, wherein said key lock core is provided inside said main body and has an inner end formed into a turnable portion that could be turned with a key, and said blocking head being located at a free end of said turnable portion and having a semi-circular cross section with a straight inner side and a curved outer side; whereby when said key lock core is turned by said key to a locked state, said blocking head is brought by said turnable portion to a position interfering with said first locking hole; and said blocked first locking hole together with said second locking hole, which is interfered by said shifting member under control of said combination lock core, effectively prevent said stopper at said movable head of said bendable shackle element from moving toward either said first or said second locking hole to move out of said locking slot, so that said lock is kept in the locked state; and when said combination lock core is in a released state, said movable head of said bendable shackle element is allowed to move toward said second locking hole and deflect said shifting member from said second locking hole, and finally moves out of said locking slot via said second locking hole to open said lock; or when said key lock core is turned by said key, and said turnable portion is driven to rotate and bring said blocking head to a position without interfering with said first locking hole, said movable head of said bendable shackle element is allowed to shift to said first locking hole and move out of said locking slot to open said lock.

4. The lock with bendable shackle element openable in two ways as claimed in claim 1, wherein said bendable shackle element is an elongate member made of a flexible material.

5. The lock with bendable shackle element openable in two ways as claimed in claim 2, wherein said bendable shackle element is an elongate member made of a flexible material.

6. The lock with bendable shackle element openable in two ways as claimed in claim 3, wherein said bendable shackle element is an elongate member made of a flexible material.

7. The lock with bendable shackle element openable in two ways as claimed in claim 1, wherein said bendable shackle element is formed from at least two rigid curved sections that are pivotally connected to one another.

8. The lock with bendable shackle element openable in two ways as claimed in claim 2, wherein said shifting member inside said main body is provided at one side in contact with said combination lock core with a laterally projected nose portion, which deflects along with said shifting member to push said combination lock core downward by an increased distance.

9. The lock with bendable shackle element openable in two ways as claimed in claim 3, wherein said straight inner side or said curved outer side of said blocking head is protruded into or moved away from a space below said first locking hole to thereby lock or open said lock, respectively.

10. The lock with bendable shackle element openable in two ways as claimed in claim 9, wherein said shifting member inside said main body is provided at one side in contact with said combination lock core with a laterally projected nose portion, which deflects along with said shifting member to push said combination lock core downward by an increased distance.

11. The lock with bendable shackle element openable in two ways as claimed in claim 2, wherein said combination lock core is provided at the inner end with a stop plate to increase an area for bearing against said shifting member, and around the inner end below said stop plate with a spring to elastically press said stop plate against said shifting member.

12. The lock with bendable shackle element openable in two ways as claimed in claim 3, wherein said combination lock core is provided at the inner end with a stop plate to increase an area for bearing against said shifting member, and around the inner end below said stop plate with a spring to elastically press said stop plate against said shifting member.

13. The lock with bendable shackle element openable in two ways as claimed in claim 4, wherein said combination lock core is provided at the inner end with a stop plate to increase an area for bearing against said shifting member, and around the inner end below said stop plate with a spring to elastically press said stop plate against said shifting member.

14. The lock with bendable shackle element openable in two ways as claimed in claim 5, wherein said combination lock core is provided at the inner end with a stop plate to increase an area for bearing against said shifting member, and around the inner end below said stop plate with a spring to elastically press said stop plate against said shifting member.

15. The lock with bendable shackle element openable in two ways as claimed in claim 6, wherein said combination lock core is provided at the inner end with a stop plate to increase an area for bearing against said shifting member, and around the inner end below said stop plate with a spring to elastically press said stop plate against said shifting member.

16. The lock with bendable shackle element openable in two ways as claimed in claim 7, wherein said combination lock core is provided at the inner end with a stop plate to increase an area for bearing against said shifting member, and around the inner end below said stop plate with a spring to elastically press said stop plate against said shifting member.

17. The lock with bendable shackle element openable in two ways as claimed in claim 8, wherein said combination lock core is provided at the inner end with a stop plate to increase an area for bearing against said shifting member, and around the inner end below said stop plate with a spring to elastically press said stop plate against said shifting member.

18. The lock with bendable shackle element openable in two ways as claimed in claim 9, wherein said combination lock core is provided at the inner end with a stop plate to increase an area for bearing against said shifting member, and around the inner end below said stop plate with a spring to elastically press said stop plate against said shifting member.

19. A lock with bendable shackle element openable in two ways, comprising a main body, a combination lock core, a bendable shackle element, and a key lock core;

said main body being provided at two adjacent first and second peripheral walls with a through hole and a long locking hole, respectively, and a guide sleeve being inward extended from said through hole;

said combination lock core being an L-shaped member having a first section parallel to a third peripheral wall adjacent to said first peripheral wall with a plurality of number rings mounted therearound for controlling a sideward movement of said combination lock core in said main body, and circumferential outer surfaces of said number rings being partially exposed from said main body; and a second section having a top laterally inward turned to form a pin portion, a free end of which is closely located at an end of said long locking hole closer to said first peripheral wall;

said bendable shackle element having two ends separately formed into a fixed head and a movable head; said fixed head being extended through said through hole into said main body and guided by said guide sleeve to connect to said second section of said L-shaped combination lock core, such that said combination lock core is shifted toward said guide sleeve when said fixed head is outward pulled; said movable head having a free end provided with an annular groove and being adapted to extend into said main body via said long locking hole, so that said pin portion of said combination lock core is engaged with said annular groove to restrict said movable head from moving; and said key lock core being provided inside said main body, and having an inner end formed into a turnable portion that is turnable using a key, a free end of said turnable portion being provided with a radially outward extended stop lug, which is adapted to extend toward the other end of said long locking hole to abut against one side of said movable head of said bendable shackle element opposite to said pin portion of said combination lock core and thereby locks said movable head in place;

whereby when said number rings are turned to release said combination lock core from a locked state, said combination lock core can be laterally outward shifted by pulling said fixed head of said bendable shackle element outward, causing said pin portion to disengage from said annular groove at said movable head of said bendable shackle element and thereby allowing said movable head to move out of said long locking hole to open said lock; or when said key lock core and said turnable portion are turned by a key to drive said stop lug away from said long locking hole, said stop lug no longer abuts against one side of said movable head and thereby allows said movable head to move out of said long locking hole to open said lock.

20. The lock with bendable shackle element openable in two ways as claimed in claim 19, wherein said bendable shackle element is an elongate member made of a flexible material.

21. The lock with bendable shackle element openable in two ways as claimed in claim 19, wherein said bendable shackle element is formed from at least two rigid curved sections that are pivotally connected to one another.

22. The lock with bendable shackle element openable in two ways as claimed in claim 20, wherein a spring is provided between said combination lock core and said main body to extend in parallel with said through hole, so as to provide said pin portion of said combination lock core with an elasticity to engage with or disengage from said annular groove around said movable head of said bendable shackle element.

23. The lock with bendable shackle element openable in two ways as claimed in claim 21, wherein a spring is provided between said combination lock core and said main body to extend in parallel with said through hole, so as to provide said pin portion of said combination lock core with an elasticity to engage with or disengage from said annular groove around said movable head of said bendable shackle element.

* * * * *